US011817652B2

(12) United States Patent
Narro et al.

(10) Patent No.: US 11,817,652 B2
(45) Date of Patent: Nov. 14, 2023

(54) ELECTRICAL CONNECTOR WITH RETRACTABLE TERMINAL-STABILIZER

(71) Applicant: Aptiv Technologies (2) S.à r.l., Luxembourg (LU)

(72) Inventors: Roberto C. Narro, Coahuila (MX); Marcelino Hernandez, Coahuila (MX)

(73) Assignee: Aptiv Technologies (2) S.à r.l., Luxembourg (LU)

( * ) Notice: Subject to any disclaimer, the term of this patent is extended or adjusted under 35 U.S.C. 154(b) by 0 days.

(21) Appl. No.: 17/688,093

(22) Filed: Mar. 7, 2022

(65) Prior Publication Data

US 2022/0190512 A1 Jun. 16, 2022

Related U.S. Application Data

(63) Continuation of application No. 16/610,690, filed as application No. PCT/US2018/029082 on Apr. 24, 2018, now Pat. No. 11,303,063.

(51) Int. Cl.
*H01R 13/629* (2006.01)
*H01R 13/631* (2006.01)
(Continued)

(52) U.S. Cl.
CPC ..... *H01R 13/629* (2013.01); *H01R 13/518* (2013.01); *H01R 13/62938* (2013.01); *H01R 13/631* (2013.01); *H01R 13/639* (2013.01)

(58) Field of Classification Search
CPC ..... H01R 13/629; H01R 13/518; H01R 13/62938; H01R 13/631
(Continued)

(56) References Cited

U.S. PATENT DOCUMENTS 5,263,871 A * 11/1993 Sano ..... H01R 13/62933 439/549
5,437,558 A * 8/1995 Sakuraoka ..... H01R 13/631 439/892
(Continued)

FOREIGN PATENT DOCUMENTS

CN 101295849 A 10/2008
CN 105264716 A 1/2016
(Continued)

OTHER PUBLICATIONS

Chinese Office Action based on CN Application No. 201880030401 dated Sep. 2, 2020, 5 pages.
Search Report based on CN Application No. 201880030401.

*Primary Examiner* — Alexander Gilman
(74) *Attorney, Agent, or Firm* — Billion & Armitage

(57) ABSTRACT

An electrical connector assembly includes a connector housing containing an electrical terminal and a mating connector housing containing a mating electrical terminal. The mating connector housing defines a connector shroud configured to receive the connector housing. The electrical connector assembly further includes a terminal stabilizer defining a terminal aperture surrounding the a electrical terminal and disposed within the connector shroud. The connector housing pushes the terminal stabilizer from a first position near a tip of the mating electrical terminal to a second position near a base of mating electrical terminal as electrical terminal is mated with the mating electrical terminal. The connector housing pulls the terminal stabilizer from the second position to the first position as the terminal is unmated from the mating electrical terminal.

18 Claims, 6 Drawing Sheets

(51) Int. Cl.
*H01R 13/518* (2006.01)
*H01R 13/639* (2006.01)

(58) Field of Classification Search
USPC ..... 439/637
See application file for complete search history.

(56) References Cited

U.S. PATENT DOCUMENTS 5,715,135 A * 2/1998 Brussalis ..... B60R 16/0238 361/624
5,788,529 A * 8/1998 Borzi ..... H01R 9/2458 29/830
5,961,337 A * 10/1999 Kordes ..... H01R 13/4538 439/141
6,220,876 B1 * 4/2001 Avila ..... H01R 9/2466 439/700
6,422,881 B1 * 7/2002 Puhl ..... H01R 13/4538 439/140
6,692,274 B2 * 2/2004 Maegawa ..... H01R 13/62933 439/157
6,739,889 B1 * 5/2004 Daggett ..... H01R 13/62938 439/372
6,761,568 B2 * 7/2004 Bakker ..... H01R 13/4538 439/140
6,821,135 B1 * 11/2004 Martin ..... H01R 13/629 439/378
6,976,858 B1 * 12/2005 Kikuchi ..... H01R 12/716 439/752
7,179,136 B1 * 2/2007 Morello ..... H01R 13/4223 439/752
7,267,562 B2 * 9/2007 Katsuma ..... H01R 13/516 439/140
7,578,709 B2 * 8/2009 Daudin ..... H01R 13/4361 439/752
7,635,212 B2 * 12/2009 Seidler ..... B60Q 3/20 362/546
7,670,177 B2 * 3/2010 Myer ..... H01R 13/4365 439/595
8,038,455 B1 * 10/2011 Moraes ..... H01R 13/4538 439/140
8,267,702 B2 * 9/2012 De La Reza ..... B60R 16/0238 439/76.1
8,267,704 B2 * 9/2012 Cheng ..... H01R 13/60 439/131
8,926,344 B2 * 1/2015 Jozwiak ..... H01R 24/66 439/140
9,054,454 B2 * 6/2015 Gomez ..... H01R 13/4538
9,509,081 B2 * 11/2016 Kobayashi ..... H01R 13/502
9,520,669 B2 * 12/2016 Gerwatowski ..... H01R 13/4538
9,748,692 B1 * 8/2017 Pardo ..... H01R 13/62933
10,193,276 B1 * 1/2019 Lanzotti ..... H01R 13/4368
10,236,629 B2 3/2019 Narro et al.
10,305,218 B2 * 5/2019 Griepenstroh ..... H01R 13/506
10,498,066 B1 * 12/2019 Sundarakrishnamachari ..... H01R 13/4538
10,763,610 B2 * 9/2020 Bae ..... H01R 13/502
2002/0168895 A1 * 11/2002 Suzuki ..... H01R 13/4365 439/752
2003/0068910 A1 * 4/2003 Casses ..... H01R 13/62933 439/157
2010/0105254 A1 * 4/2010 Park ..... H01R 13/4538 439/752
2013/0007935 A1 * 1/2013 Chin ..... F41F 3/04 244/33
2016/0079699 A1 * 3/2016 Kobayashi ..... H01R 13/502 439/660
2018/0323538 A1 * 11/2018 Narro ..... H01R 13/629

FOREIGN PATENT DOCUMENTS

JP 2605189 B2 4/1997
JP 2016042455 A 3/2016
KR 20130046127 A 5/2013

* cited by examiner

ELECTRICAL CONNECTOR WITH RETRACTABLE TERMINAL-STABILIZER

CROSS REFERENCE TO RELATED APPLICATION

This application is a continuation application of U.S. application Ser. No. 16/610,690 having a filing date of Nov. 4, 2019 which is a national stage application under 35 U.S.C. § 371 of PCT Application Number PCT Application Number PCT/US18/29082 having an international filing date of Apr. 24, 2018, which designated the United States, said PCT application claiming the benefit of U.S. patent application Ser. No. 15/588,777, now U.S. Pat. No. 10,236,629, filed on May 8, 2017, the entire disclosure of each which is hereby incorporated by reference.

TECHNICAL FIELD OF INVENTION

This disclosure generally relates to an electrical connector assembly, and more particularly relates to an electrical connector assembly having a retractable terminal stabilizer device.

BACKGROUND OF INVENTION

An electrical distribution center is typically used in automotive vehicles to interconnect various electrical wiring assemblies. The electrical distribution center assembly may also be used in other non-vehicular applications. The typical electrical distribution center may package various fuses, relays, and other electrical devices, in a central location and may include provisions for electrically connecting a power source to electrical wiring harnesses that supply power and control signals to various electrical systems of the vehicle. Examples of electrical distribution centers may be found in U.S. Pat. No. 5,715,135 granted to Brussalis et al., U.S. Pat. No. 5,788,529 granted to Borzi et al., U.S. Pat. No. 6,220,876 granted to Avila et al., U.S. Pat. No. 6,739,889 granted to Daggett et al., and U.S. Pat. No. 7,635,212 granted to Seidler.

A known electrical distribution center that incorporates a connector shroud includes a non-movable floor positioned at the base of male blade electrical terminals to provide some level of blade dimensional stabilization prior to mating with a wiring harness connector. For additional blade stabilization and protection from damage prior to connector mating, a separate electrical terminal stabilizer plate is mounted to the shroud to capture the terminals near the terminal tips. Terminal stabilizer plates also function to keep undesired foreign matter, or debris out of the connector system environment to prevent intermittent electrical connections between the mated terminals, and to prevent blockage between the connectors that may impede the mating of the connection system. The terminal stabilizer plate may be attached using tabs that are inserted into slots in the shroud as shown in U.S. Pat. No. 6,422,881 granted to Puhl, et al.

The terminal stabilizer plate may be integrally molded into shroud with breakaway portions, as shown in U.S. Pat. No. 8,267,704 granted to De La Reza et al. In this design, when the connector body is mated to the electrical distribution center, there is a momentary increase in force needed to insert the connector body into the shroud as the tabs are pushed out of the slots or the breakaway portions are broken.

Jozwiak shows, in U.S. Pat. No. 8,926,344, a terminal stabilizer plate held in the shroud at a ready position by a releasable latch means. In this design, when the connector body is mated to the electrical distribution center, the terminal stabilizer plate is pushed out of flexible locks and toward the connector floor to the base of the terminals.

A retractable terminal stabilizer plate typically couples with the mating connector such that the stabilizer plate moves back to the ready position when the mating connectors is removed. Current retractable stabilizer plate connection systems typically require an undesired high coupling force during the process of mating and unmating of connection system. Reducing the coupling force to operate the retractable stabilizer reduces the overall coupling force needed to mate and unmate the connection system. As current connection system configurations age over their useful service life in an application, the elements of the connection system, including the retractable stabilizer, may become fatigued to the point where the retractable stabilizer may not retract back to the ready position when the connection system is unmated. If the retractable stabilizer remains undesirably positioned deep in the mating connector when the connection system is unmated, an increased portion of the male terminals are exposed above the retractable stabilizer which increases the risk for male terminal damage. Damaged male terminals require servicing to the connection system which undesirably increases repair costs of the connection system.

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

SUMMARY OF THE INVENTION

In accordance with one embodiment, an electrical connector assembly is provided. The electrical connector assembly includes a connector, a corresponding mating connector, and a terminal stabilizer. The connector has a plurality of electrical terminals. The connector also has an outer surface that includes a plurality of retraction fins. The mating connector has a plurality of mating electrical terminals. The mating connector is releasably connected to the connector along a mating axis. The electrical terminals interconnect with the mating electrical terminals when the connector is moved from an unmated position to a mated position. The mating connector includes a connector shroud having side walls defining a shroud cavity configured to receive the connector therein and a base. The terminal stabilizer is slideably disposed within the shroud cavity and includes a plurality of retraction locks that engage the plurality of retraction fins on the connector. The terminal stabilizer defines a plurality of terminal apertures that slideably engage the plurality of mating electrical terminals. The terminal stabilizer is moveable from a prestaged position, when the connector and the mating connector are in the unmated position, to a seated position, when the connector is moved to the mated position. The connector retracts the terminal stabilizer from the seated position to the prestaged position when the connector is moved from the mated position to the unmated position.

Further features and advantages will appear more clearly on a reading of the following detailed description of the preferred embodiment, which is given by way of nonlimiting example only and with reference to the accompanying drawings.

BRIEF DESCRIPTION OF DRAWINGS

The present invention will now be described, by way of example with reference to the accompanying drawings, in which.

DETAILED DESCRIPTION

Figure 1:
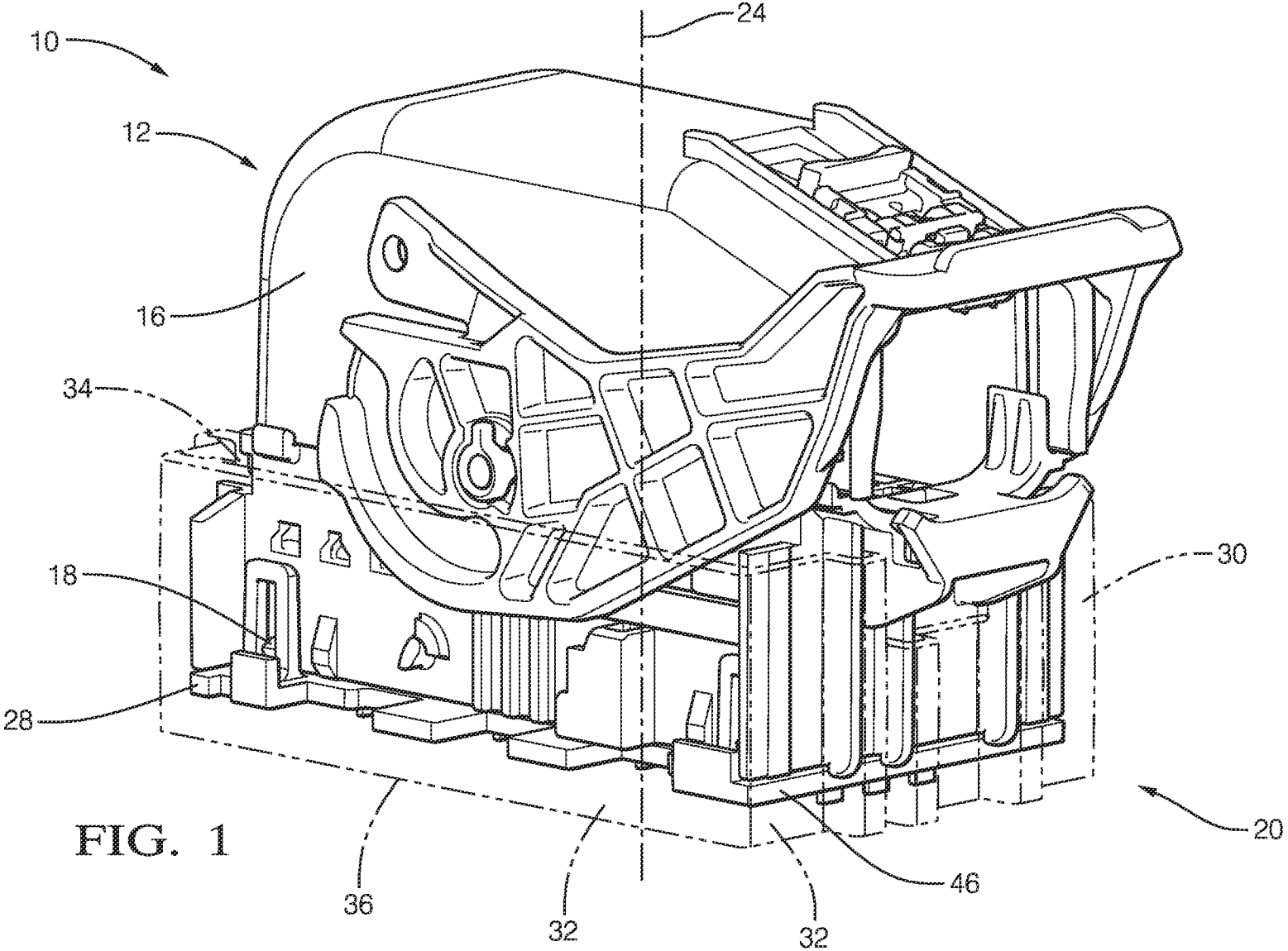
FIG. 1 is an illustration of a cut-away view of an electrical connector assembly in accordance with one embodiment.

FIG. 1 illustrates a nonlimiting example of an electrical connector assembly 10, hereafter referred to as the assembly 10. The assembly 10 includes a connector 12 having a plurality of electrical terminals 14 (see FIG. 5A), and an outer surface 16 that has a plurality of retraction fins 18.

Figure 2:
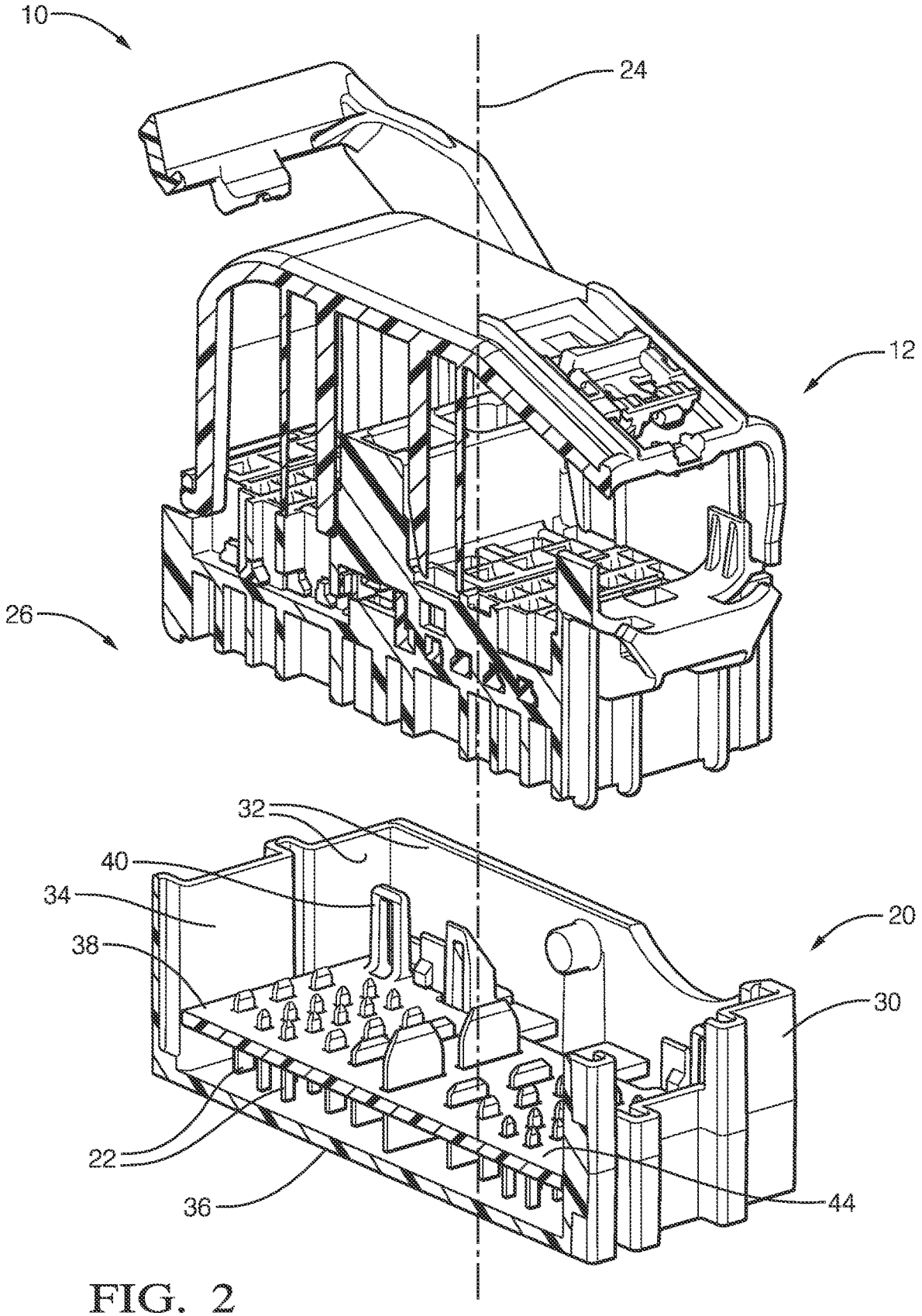
FIG. 2 is an illustration of a cross section view of the connector assembly of FIG. 1 in an unmated position in accordance with one embodiment.
Figure 6:
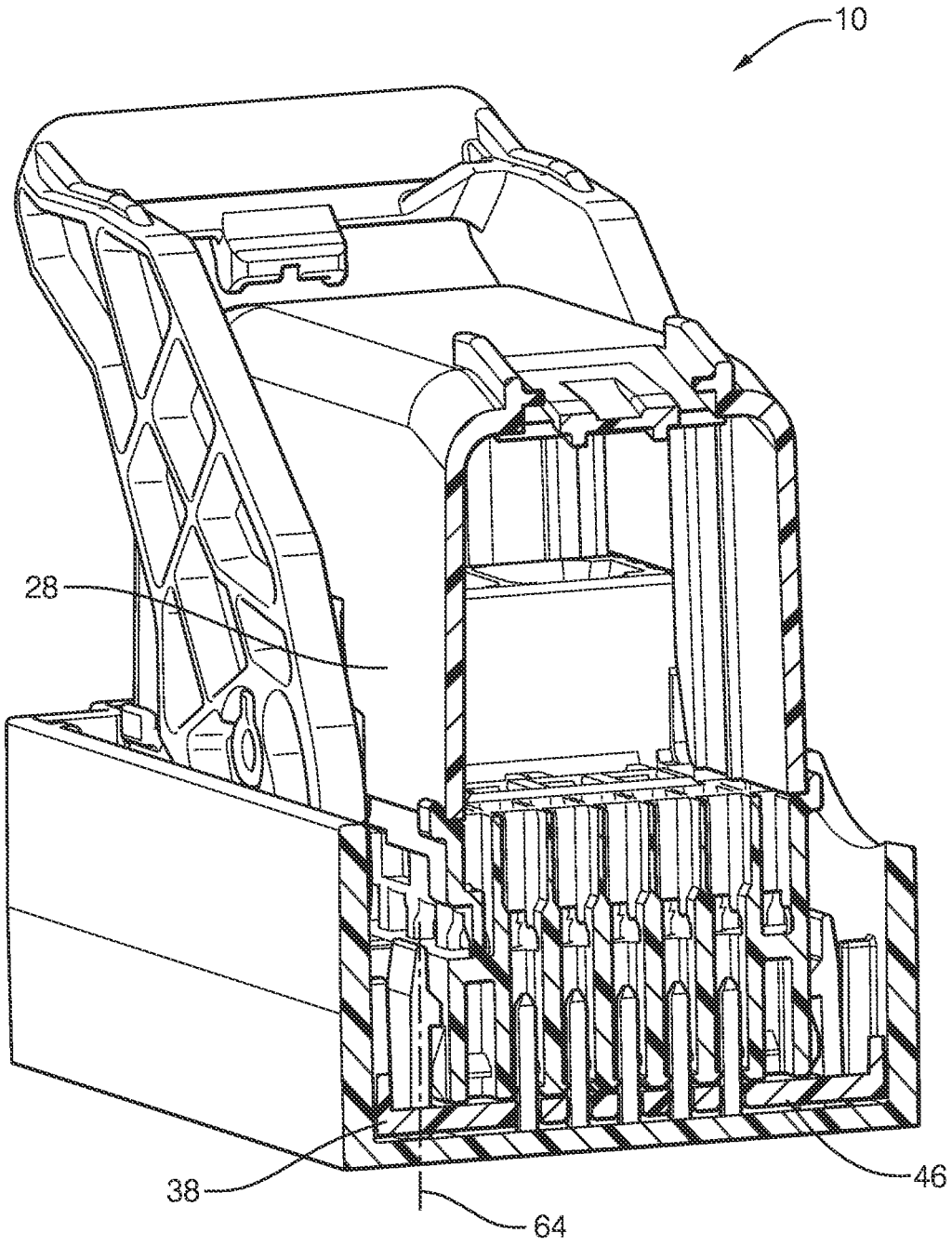
FIG. 6 is a cross section view of an illustration of the connector assembly of FIG. 1 in a mated position with the terminal stabilizer in a seated position in accordance with one embodiment.

The assembly 10 also includes a corresponding mating connector 20 having a plurality of mating electrical terminals 22 (see FIG. 2). The mating connector 20 is releasably connected to the connector 12 along a mating axis 24 such that the electrical terminals 14 mate with the mating electrical terminals 22 when the connector 12 is moved from an unmated position 26 (see FIG. 2) to a mated position 28 (see FIG. 6). The mating connector 20 includes a connector shroud 30 having side walls 32 that define a shroud cavity 34 configured to receive the connector 12, and a base 36.

Figure 3A:
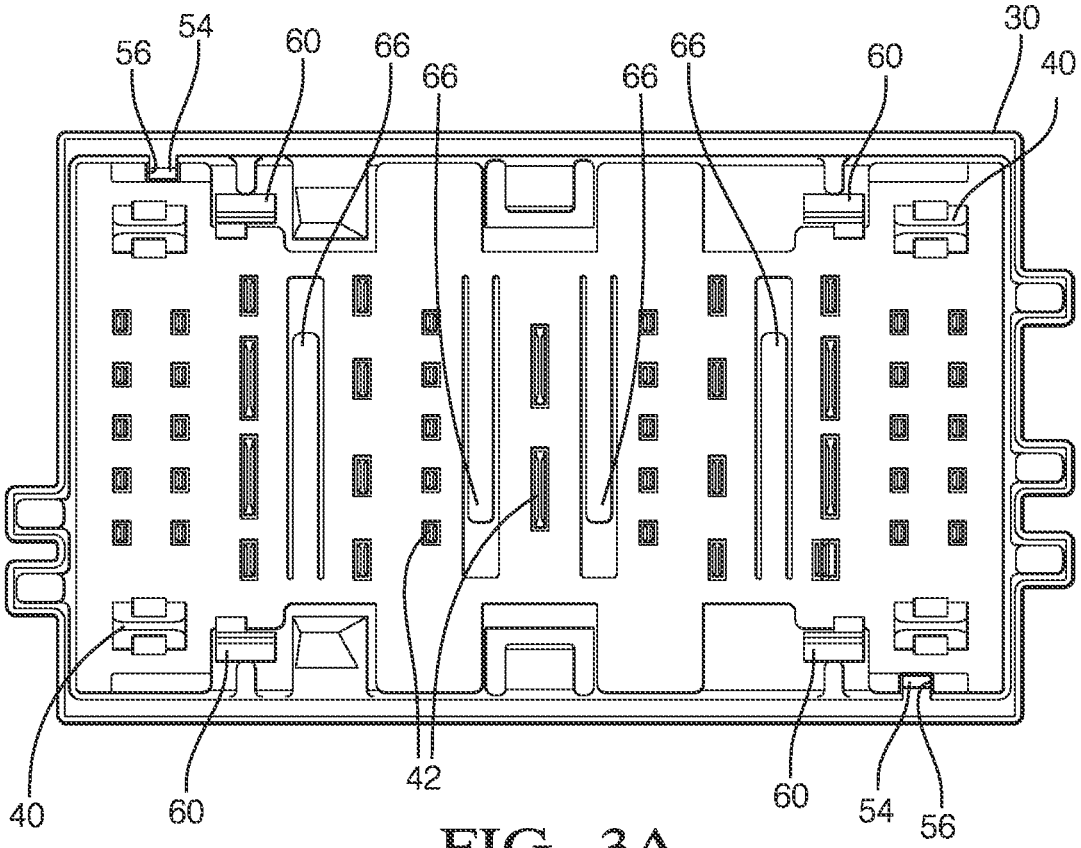
FIG. 3A is an illustration of the terminal stabilizer disposed of FIG. 2 within the mating connector of FIG. 2 in accordance with one embodiment.
Figure 3B:
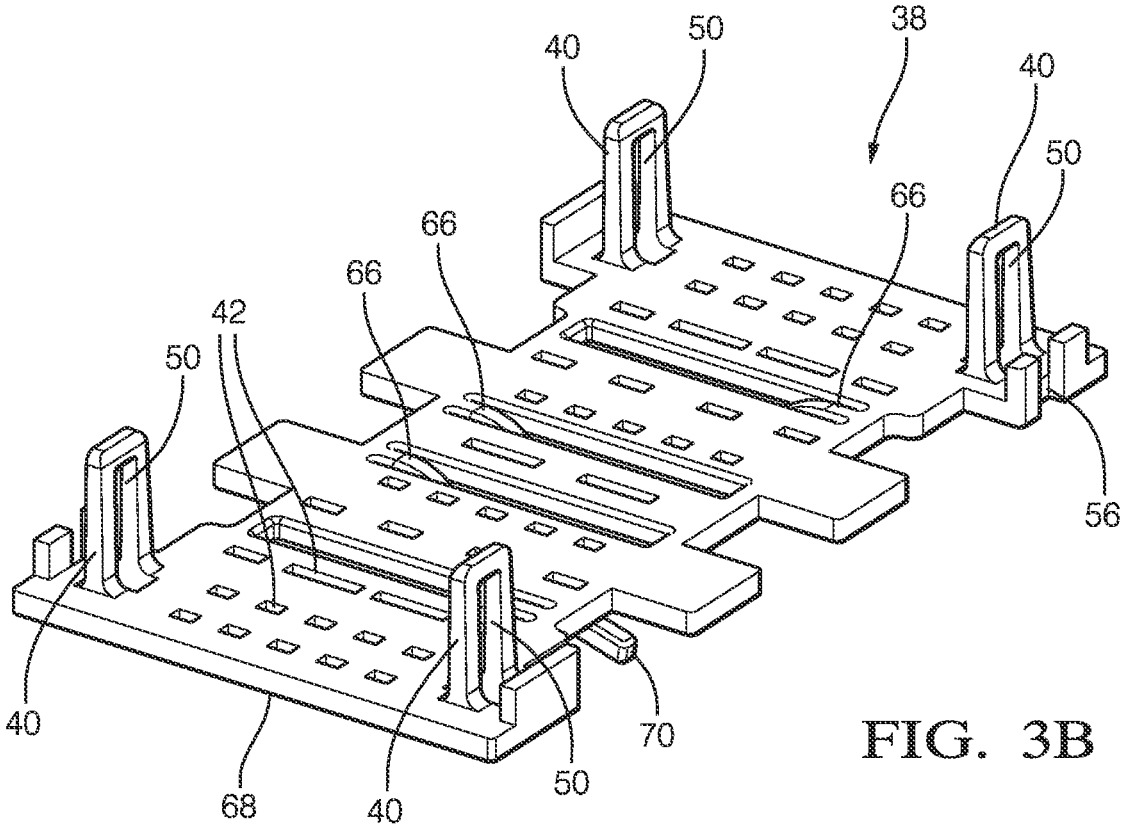
FIG. 3B is an illustration of the terminal stabilizer of FIG. 2 in accordance with one embodiment.
Figure 4:
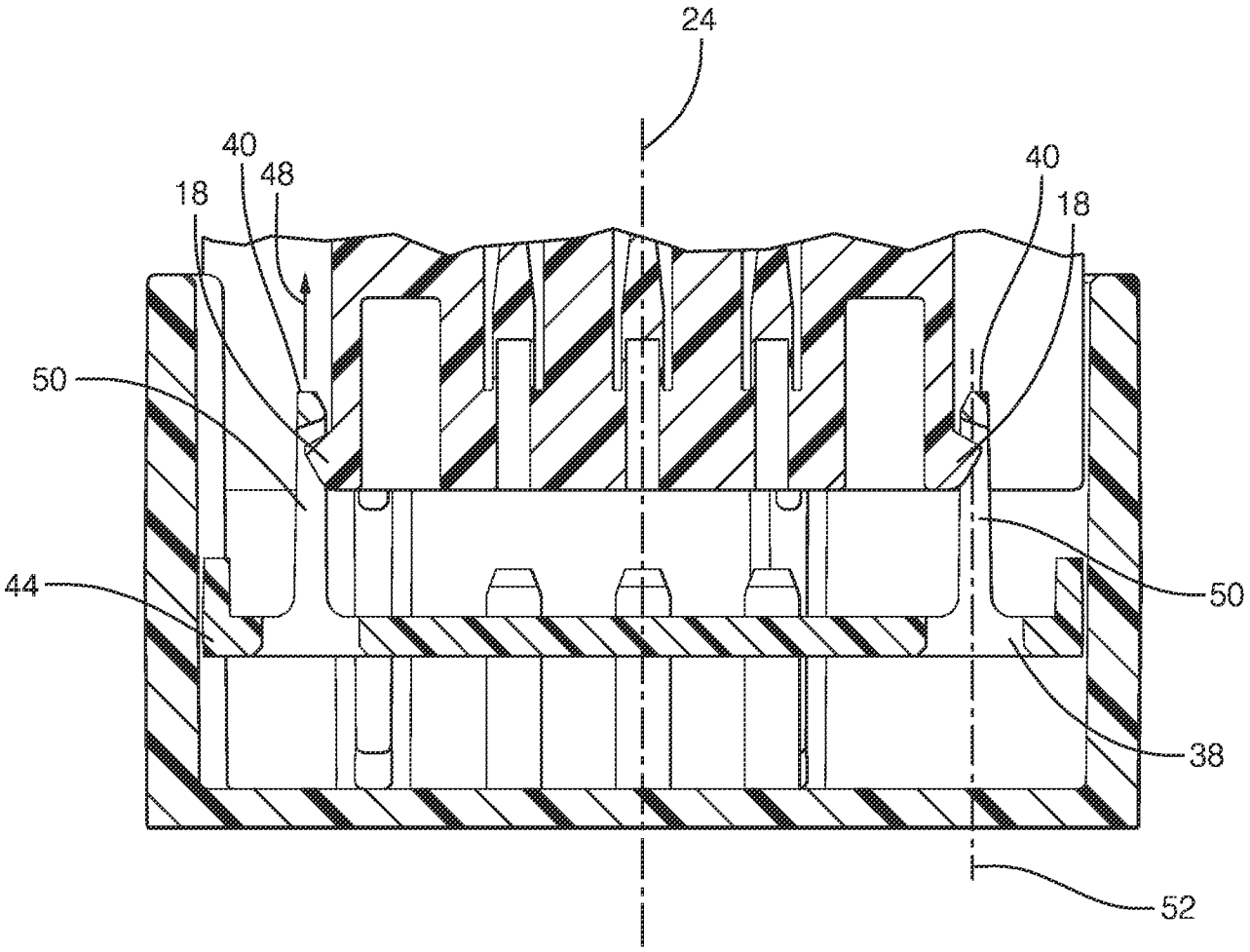
FIG. 4 is an illustration of the connector of FIG. 1 with retraction fins engaged with retraction locks of the terminal stabilizer of FIG. 2 in accordance with one embodiment.

The assembly 10 also includes a terminal stabilizer 38 (see FIG. 2) slideably disposed within the shroud cavity 34 that includes a plurality of retraction locks 40. The terminal stabilizer 38 defines a plurality of terminal apertures 42 (see FIG. 3A and 3B) that slideably engage the plurality of mating electrical terminals 22. The retraction locks 40 may releasably engage the plurality of retraction fins 18 on the connector 12 when the connector 12 is inserted into the mating connector 20, as illustrated in FIG. 4. The terminal stabilizer 38 is moveable from a prestaged position 44, when the connector 12 and the mating connector 20 are in the unmated position 26 (see FIG. 2) to a seated position 46 when the connector 12 is moved to the mated position 28 (see FIG. 1).

The connector 12 may retract 48 the terminal stabilizer 38 from the seated position 46 to the prestaged position 44 when the connector 12 is moved from the mated position 28 to the unmated position 26 (see FIG. 4). Retracting 48 the terminal stabilizer 38 to the prestaged position 44 is advantageous because the terminal stabilizer 38 may protect the mating electrical terminals 22 when the assembly 10 must be disconnected during periods of service. The retraction fins 18 remain engaged with the retraction locks 40 until the connector 12 is separated from the mating connector 20. The retraction fins 18 are configured with ramps (not specifically shown) on a leading edge and a trailing edge that displace the retraction locks 40 perpendicular to the mating axis 24 until the retraction fins 18 are engaged and/or disengaged from the retraction locks 40. The retraction locks 40 define a retraction slot 50 (see FIG. 3B) that slideably retains the retraction fins 18 and enables the connector 12 to travel to the mated position 28 with minimal frictional resistance. The retraction locks 40 may return to a neutral flex position 52 (see FIG. 4) that does not have a deflection from perpendicular to the mating axis 24 when the retraction locks 40 retain the retraction fins 18.

The connector shroud 30 may include a plurality of index beams 54 and the terminal stabilizer 38 may include a plurality of corresponding index slots 56 (see FIGS. 3A and 3B) that slideably engage the plurality of index beams 54. The index beams 54 ensure a correct installation position of the terminal stabilizer 38 in the connector shroud 30 and may prevent any misalignment of the terminal stabilizer 38 while the connector 12 is moved from the mated position 28 to the unmated position 26.

Figure 5B:
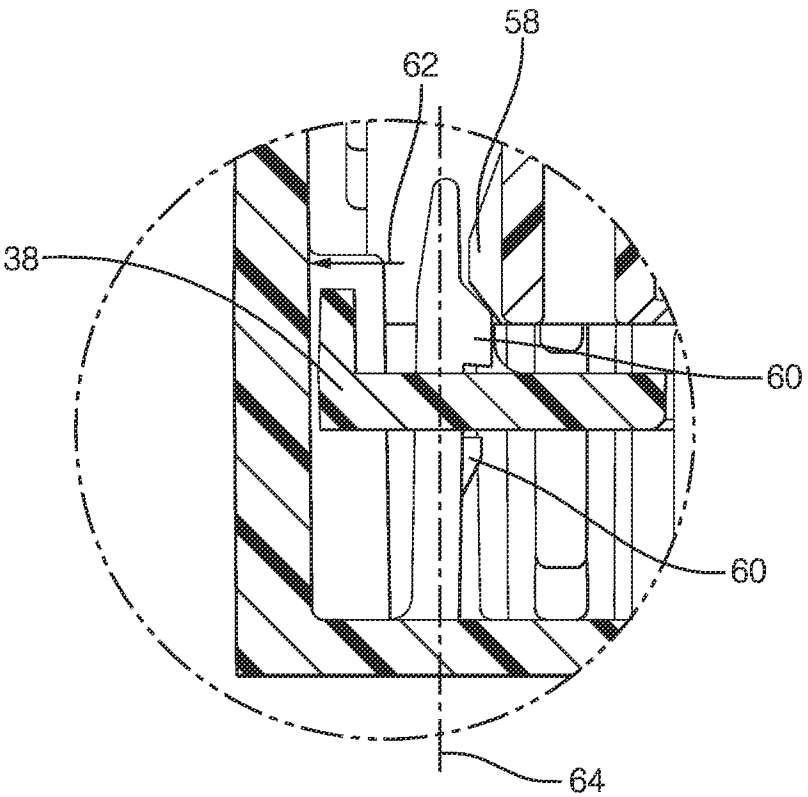
FIG. 5B is a close-up view of the release ramps and beam locks of FIG. 5A in accordance with one embodiment.
Figure 5A:
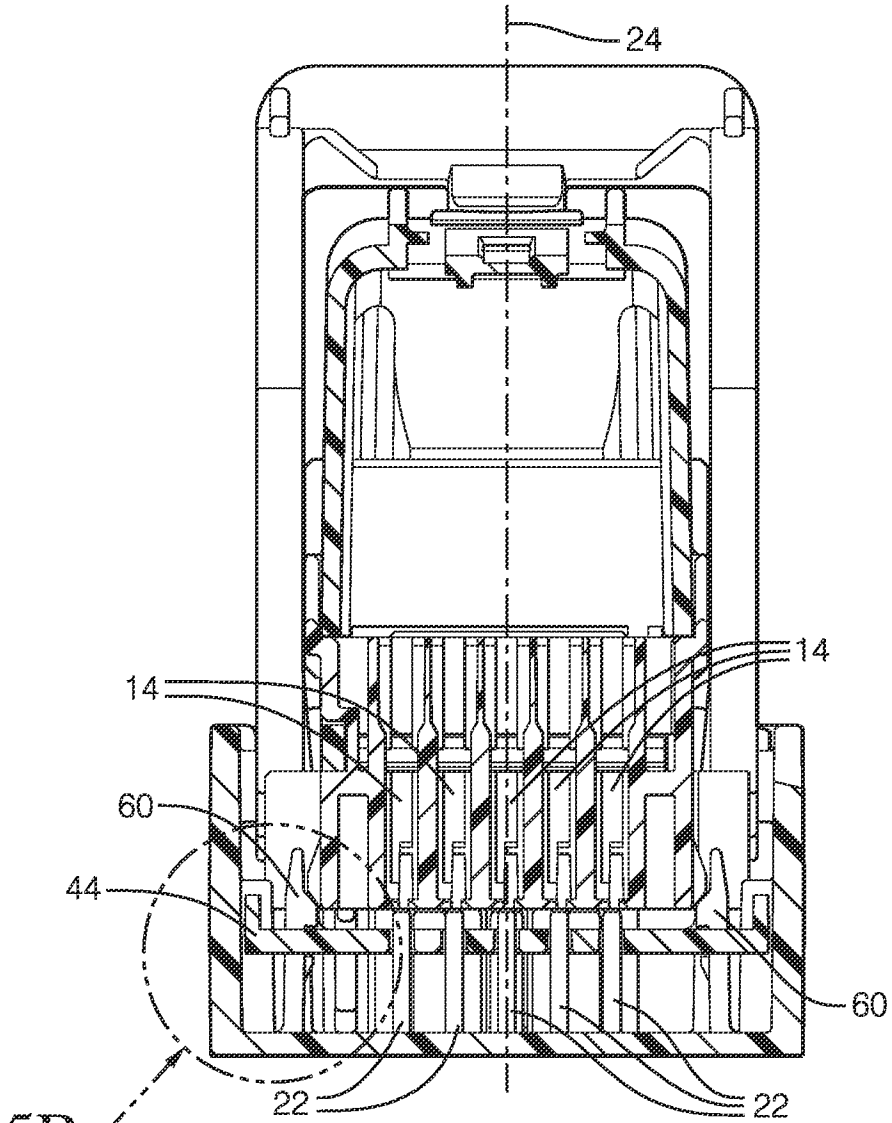
FIG. 5A is an illustration of the electrical connector assembly of FIG. 1 with release ramps and beam locks in accordance with one embodiment.

The connector 12 may also include a plurality of release ramps 58, and the base 36 may also include a plurality of corresponding beam locks 60 configured to retain the terminal stabilizer 38 in the prestaged position 44 (see FIGS. 5A and 5B). The beam locks 60 prevent movement of the terminal stabilizer 38 until the retraction fins 18 engage the retraction locks 40, and the plurality of release ramps 58 displace the plurality of beam locks 60 in a lateral direction 62 perpendicular to the mating axis 24. The displacement of the beam locks 60 enables the terminal stabilizer 38 to move to the seated position 46 (see FIG. 6) when the connector 12 is moved from the unmated position 26 to the mated position 28. The beam locks 60 may return to a relaxed position 64 that do not have a deflection from perpendicular to the mating axis 24 after the terminal stabilizer 38 is moved to the seated position 46 (see FIG. 6). When the connector 12 is moved from the mated position 28 to the unmated position 26 the retraction fins 18 retract 48 the terminal stabilizer 38 until the beam locks 60 capture edges of the terminal stabilizer 38 and a pull out force on the connector 12 exceeds the force required to retain the retraction fins 18 within the retraction locks 40, thus disconnecting the assembly 10.

The terminal stabilizer 38 may further include a resilient member 66 (see FIGS. 3A and 3B) projecting from a bottom surface 68 of the terminal stabilizer 38 configured to exert a spring force on the base 36 in order to urge the terminal stabilizer 38 from the seated position 46 to the prestaged position 44. The resilient member 66 may be characterized as having an arcuate shape 70. The terminal stabilizer 38 may also include a plurality of resilient members 66 projecting from the bottom surface 68 of the terminal stabilizer 38 configured to urge the terminal stabilizer 38 from the seated position 46 to the prestaged position 44.

Accordingly, an electrical connector assembly 10 provided. The electrical connector assembly 10 includes the retractable terminal stabilizer 38 that reduces the overall coupling force needed to mate and unmate the connection system, compared to prior art retractable terminal stabilizers, by eliminating any breakaway features molded into the terminal stabilizer. The release ramps 58 integrated into the connector 12 further reduce the overall coupling force needed to mate and unmate the connection system by reducing the frictional forces generated through the interaction with the ramp features of the beam locks 60. The terminal stabilizer 38 retraction locks 40 and the mating connector 20 beam locks 60 return to the position having no deflection perpendicular to the mating axis 24 after the terminal stabilizer 38 is moved to the seated position 46.

While this invention has been described in terms of the preferred embodiments thereof, it is not intended to be so limited, but rather only to the extent set forth in the claims that follow. Moreover, the use of the terms first, second, etc. does not denote any order of importance, but rather the terms first, second, etc. are used to distinguish one element from another. Furthermore, the use of the terms a, an, etc. do not denote a limitation of quantity, but rather denote the presence of at least one of the referenced items. Additionally, directional terms such as upper, lower, etc. do not denote any particular orientation, but rather the terms upper, lower, etc. are used to distinguish one element from another and locational establish a relationship between the various elements.

The invention claimed is:

1. An electrical connector assembly, comprising:

a connector housing containing at least one electrical terminal;

a mating connector housing containing at least one mating electrical terminal wherein, the mating connector housing defines a connector shroud configured to receive the connector housing; and a terminal stabilizer defining at least one terminal aperture surrounding the at least one mating electrical terminal and disposed within the connector shroud, wherein the connector housing pushes the terminal stabilizer from a first position near a tip of the at least one mating electrical terminal to a second position near a base of the at least one mating electrical terminal as the at least one electrical terminal is mated with the at least one mating electrical terminal and wherein the connector housing pulls the terminal stabilizer from the second position to the first position as the at least one electrical terminal is unmated from the at least one mating electrical terminal, wherein the terminal stabilizer further includes a resilient member projecting from a bottom surface of the terminal stabilizer configured to urge the terminal stabilizer from the second position to the first position.

2. The electrical connector assembly in accordance with claim 1, wherein the connector housing defines a retraction fin that engages a retraction lock defined by the terminal stabilizer and wherein the retraction fin pulls the terminal stabilizer from the second position to the first position as the at least one electrical terminal is unmated from the at least one mating electrical terminal.

3. The electrical connector assembly in accordance with claim 2, wherein the retraction lock defines a retraction slot configured to receive the retraction fin.

4. The electrical connector assembly in accordance with claim 3, wherein the retraction fin engages the retraction lock as the connector housing is inserted within the connector shroud, and wherein the retraction lock returns to a neutral flexed position parallel to a mating axis of the mating connector housing after the retraction fin is received within the retraction slot.

5. The electrical connector assembly in accordance with claim 1, wherein the connector shroud includes an index beam and wherein the terminal stabilizer includes an index slot that cooperates with the index beam to ensure a correct installation position of the terminal stabilizer in the connector shroud and prevent misalignment of the terminal stabilizer as it moves between the first and second positions.

6. The electrical connector assembly in accordance with claim 1, wherein the connector housing includes a release ramp and wherein the mating connector housing includes a beam lock configured to retain the terminal stabilizer in the first position until the release ramp displaces the beam lock in an outward direction as the connector housing is inserted within the connector shroud, thereby enabling the terminal stabilizer to move to the second position.

7. The electrical connector assembly in accordance with claim 6, wherein the beam lock is in a relaxed position parallel to a mating axis of the mating connector housing and the connector housing when the terminal stabilizer is in the second position.

8. The electrical connector assembly in accordance with claim 1, wherein the terminal stabilizer is configured to urge the terminal stabilizer from the second position to the first position as the at least one electrical terminal is unmated from the at least one mating electrical terminal.

9. The electrical connector assembly in accordance with claim 1, wherein the resilient member is integrally formed with the terminal stabilizer and has an arcuate shape.

10. An electrical connector assembly, comprising:

a connector housing containing at least one electrical terminal;

a mating connector housing defining a connector shroud that is configured to receive the connector housing containing at least one mating electrical terminal;

a terminal stabilizer disposed within the connector shroud defining at least one terminal aperture in which the at least one electrical terminal is disposed; and a resilient means for moving the terminal stabilizer from a first position near a base of the at least one mating electrical terminal to a second position near a tip of the at least one mating electrical terminal, wherein the resilient means projects from a bottom surface of the terminal stabilizer.

11. The electrical connector assembly in accordance with claim 10, wherein the means for moving the terminal stabilizer is configured to move the terminal stabilizer from the first position to the second position as the at least one electrical terminal is unmated from the at least one mating electrical terminal.

12. The electrical connector assembly in accordance with claim 10, wherein the means for moving the terminal stabilizer is configured to pull the terminal stabilizer as the at least one electrical terminal is unmated from the at least one mating electrical terminal, thereby urging the terminal stabilizer from the first position to the second position.

13. The electrical connector assembly in accordance with claim 10, wherein the means for moving the terminal stabilizer is configured to ensure a correct installation position of the terminal stabilizer in the connector shroud and prevent misalignment of the terminal stabilizer as it moves between the first and second positions.

14. The electrical connector assembly in accordance with claim 10, wherein the means for moving the terminal stabilizer is configured to retain the terminal stabilizer in the second position until the connector housing is inserted within the connector shroud.

15. An electrical connector, comprising:

a connector housing containing at least one electrical terminal and defining a retraction fin;

a mating connector housing containing at least one mating electrical terminal wherein, the mating connector housing defines a connector shroud in which the connector housing is received; and a terminal stabilizer disposed within the connector shroud and defining a retraction lock configured to engage the retraction fin to pull the terminal stabilizer from a position near a base of the at least one mating electrical terminal to a position near a tip of the at least one mating electrical terminal as the at least one electrical terminal is unmated from the at least one mating electrical terminal, wherein a resilient member projecting from a bottom surface of the terminal stabilizer is configured urge the terminal stabilizer from the position near the base of the at least one mating electrical terminal to the position near the tip of the at least one mating electrical terminal.

16. The electrical connector in accordance with claim 15, wherein the retraction lock defines a retraction slot that slideably retains the retraction fin, wherein the retraction lock is in a neutral flex position when the retraction lock engages the retraction fin.

17. The electrical connector in accordance with claim 15, wherein the resilient member urges the terminal stabilizer as the at least one electrical terminal is unmated from the at least one mating electrical terminal.

18. The electrical connector in accordance with claim 15, wherein the resilient member is characterized as having an arcuate shape.

* * * * *